US005328593A

United States Patent [19]

Owen et al.

[11] Patent Number: 5,328,593

[45] Date of Patent: Jul. 12, 1994

[54] MULTI-STAGE REGENERATION OF CATALYST WITH TRAPPED CO COMBUSTION PROMOTER

[75] Inventors: Hartley Owen, Worton, Md.; Paul H. Schipper, Doylestown, Pa.

[73] Assignee: Mobil Oil Corporation, Fairfax, Va.

[21] Appl. No.: 997,747

[22] Filed: Dec. 30, 1992

[51] Int. Cl.[5] ..... C10G 11/00

[52] U.S. Cl. ..... 208/113; 208/153

[58] Field of Search ..... 208/113, 153; 502/42, 502/43

[56] References Cited

U.S. PATENT DOCUMENTS 3,808,121 4/1974 Wilson ..... 208/113
4,927,348 5/1990 Avidan ..... 431/7
5,034,115 7/1991 Avidan ..... 208/113
5,101,743 4/1992 Hirschberg et al. ..... 110/345

*Primary Examiner*—R. Bruce Breneman
*Assistant Examiner*—Walter D. Griffin
*Attorney, Agent, or Firm*—Alexander J. McKillop; Malcolm D. Keen; Richard D. Stone

[57] ABSTRACT

A process for multistage regeneration of spent FCC catalyst in an "Orthoflow" or stacked FCC unit having a stripper mounted over the regenerator. Spent catalyst is discharged into a fast fluidized bed coke combustor heated by direct contact heat exchange with catalyst and large particles or beads of CO combustion promoter. The large particle CO combustion promoter is trapped in the coke combustor, to permit complete CO combustion, with limited coke combustion.

11 Claims, 2 Drawing Sheets

MULTI-STAGE REGENERATION OF CATALYST WITH TRAPPED CO COMBUSTION PROMOTER

BACKGROUND OF THE INVENTION

1. Field of the Invention

The invention relates to a process and apparatus for stripping and regenerating fluidized catalytic cracking catalyst.

2. Description of Related Art

In the fluidized catalytic cracking (FCC) process, catalyst, having a particle size and color resembling table salt and pepper, circulates between a cracking reactor and a catalyst regenerator. In the reactor, hydrocarbon feed contacts a source of hot, regenerated catalyst. The hot catalyst vaporizes and cracks the feed at 425°-600° C., usually 460°-560° C. The cracking reaction deposits carbonaceous hydrocarbons or coke on the catalyst, thereby deactivating the catalyst. The cracked products are separated from the coked catalyst. The coked catalyst is stripped of volatiles, usually with steam, in a catalyst stripper and the stripped catalyst is then regenerated. The catalyst regenerator burns coke from the catalyst with oxygen containing gas, usually air. Decoking restores catalyst activity and simultaneously heats the catalyst to, e.g., 500°-900° C., usually 600°-750° C. This heated catalyst is recycled to the cracking reactor to crack more fresh feed. Flue gas formed by burning coke in the regenerator may be treated for removal of particulates and for conversion of carbon monoxide, after which the flue gas is normally discharged into the atmosphere.

Catalytic cracking has undergone progressive development since the 40s. The trend of development of the fluid catalytic cracking (FCC) process has been to all riser cracking and use of zeolite catalysts. A good overview of the importance of the FCC process, and its continuous advancement, is reported in Fluid Catalytic Cracking Report, Amos A. Avidan, Michael Edwards and Hartley Owen, as reported in the Jan. 8, 1990 edition of the Oil & Gas Journal.

Modern catalytic cracking units use active zeolite catalyst to crack the heavy hydrocarbon feed to lighter, more valuable products. Instead of dense bed cracking, with a hydrocarbon residence time of 20-60 seconds, less contact time is needed. The desired conversion of feed can now be achieved in much less time, and more selectively, in a dilute phase, riser reactor.

Although reactor residence time has continued to decrease, the height of the reactors has not. Although the overall size and height of much of the hardware associated with the FCC unit has decreased, the use of all riser reactors has resulted in catalyst and cracked product being discharged from the riser reactor at a fairly high elevation. This elevation makes it easy for a designer to transport spent catalyst from the riser outlet, to a catalyst stripper at a lower elevation, to a regenerator at a still lower elevation.

The need for a somewhat vertical design, to accommodate the great height of the riser reactor, and the need to have a unit which is compact, efficient, and has a small "footprint", has caused considerable evolution in the design of FCC units, which evolution is reported to a limited extent in the Jan. 8, 1990 Oil & Gas Journal article. One modern, compact FCC design is the Kellogg Ultra Orthoflow converter, Model F, which is shown in FIG. 1 of this patent application, and also shown as FIG. 17 of the Jan. 8, 1990 Oil & Gas Journal article discussed above. The compact nature of the design, and the use of a catalyst stripper which is contiguous with and supported by the catalyst regenerator, makes it difficult to expand or modify such units. The catalyst stripper design is basically a good one, which achieves some efficiencies because of its location directly over the bubbling bed regenerator. The stripper can be generously sized, does not have to fit around the riser reactor as in many other units, and the stripper is warmed some by proximity to the regenerator, which improves stripper efficiency slightly.

Although such a unit works well in practice, the regenerator operates with a relatively large catalyst inventory, a much larger catalyst inventory than would be required in a high efficiency regenerator. The long residence time, and relatively high steam partial pressure associated with single stage bubbling bed catalyst regeneration causes an undesirable amount of catalyst deactivation. We realized that it would be beneficial if the regenerator environment could be made drier, and/or if catalyst regeneration in such a regenerator could be conducted in stages, rather than in a single dense bed.

Some or our recent work has been directed to achieving multi-stage regeneration in such bubbling dense bed regenerators, such as our U.S. Pat. Nos. 5,032,251, 5,034,115 and 5,047,140 which are incorporated by reference.

Although all of the improvements listed above were in the right direction, they were not the complete solution. The approaches discussed above generally led to higher particulate loading than was desired in the dilute phase region above the bubbling dense bed. The approaches did not permit as much control as was desired in regard to the amount of catalyst recirculation to the coke combustor. Finally, we wanted to be able to achieve true multi-stage regeneration of catalyst, with complete CO combustion in the first stage, but only partial coke combustion. We had three goals:

1. Provide a simple and reliable way to control regenerated catalyst recycle to a fast fluidized bed coke combustor in an Orthoflow regenerator.

2. Have the benefits of high superficial vapor velocity first stage regeneration in a coke combustor immersed in a bubbling dense bed, without undue increase in dust loading in vapor space above the dense bed.

3. Incorporate a relatively fail safe method for achieving complete CO combustion, with only limited coke combustion, in the first stage of such a regenerator, without adding large amounts of Pt to the FCC catalyst inventory.

We developed several designs or modifications which reached the above goals.

BRIEF SUMMARY OF THE INVENTION

Accordingly, the present invention provides a fluidized catalytic cracking process wherein a heavy hydrocarbon feed comprising hydrocarbons having a boiling point above about 650 F. is catalytically cracked to lighter products comprising the steps of: catalytically cracking said feed in a catalytic cracking zone operating at catalytic cracking conditions by mixing, in the base of a riser reactor, a heavy crackable feed with a source of hot regenerated catalytic cracking catalyst having an average particle size within the range of about 40 to 100 microns diameter withdrawn from a catalyst regenerator, and cracking said feed in said riser reactor to produce catalytically cracked products and spent catalyst which are discharged from the top of the riser into a catalyst disengaging zone wherein cracked products are separated from spent catalyst; separating cracked products from spent catalyst in said catalyst disengaging zone to produce a cracked product vapor phase which is recovered as a product and a spent catalyst phase which is discharged from said disengaging zone into a catalyst stripper contiguous with and beneath said disengaging zone; steam stripping said spent catalyst with stripping steam in said stripping zone to produce a stripper vapor comprising cracked products and stripping steam which is removed from said stripping zone as a product and a stripped catalyst phase comprising stripped catalyst having a temperature is discharged into a vertical standpipe beneath said stripping zone; discharging stripped catalyst from said standpipe into a coke combustor catalyst regeneration zone contiguous with and beneath said stripping zone operating at catalyst regeneration conditions including a temperature above 1100° F., a superficial vapor velocity above 3 feet per second and sufficient to maintain at least turbulent or fast fluidized bed conditions to produce at least partially regenerated catalyst and flue gas containing CO and $CO_2$; afterburning within said coke combustor CO to $CO_2$ by contacting within said coke combustor said CO containing flue gas with a trapped CO combustion promoter disposed on particles having an average particle diameter of at least 250 microns and sufficiently large to have settling characteristics within said coke combustor so that the average residence time of said trapped CO combustion promoter is at least an order of magnitude larger than a residence time of said conventional FCC catalyst; discharging upwardly from said coke combustor a dilute phase mixture of flue gas and at least partially regenerated FCC catalyst into a superimposed dilute phase transport riser mounted above said coke combustor; discharging from said dilute phase transport riser at least partially regenerated FCC catalyst and flue gas containing less than 2.0 mole % CO; separating said discharged FCC catalyst from flue gas and collecting said discharged FCC catalyst in a dense phase fluidized bed encompassing at least a portion of said coke combustor; withdrawing regenerated catalyst from said dense phase fluidized bed and charging same to said base of said riser reactor.

In a more specific embodiment, the present invention provides a fluidized catalytic cracking process wherein a heavy hydrocarbon feed comprising hydrocarbons having a boiling point above about 650° F. is catalytically cracked to lighter products comprising the steps of: catalytically cracking said feed in a catalytic cracking zone operating at catalytic cracking conditions by mixing, in the base of a riser reactor, a heavy crackable feed with a source of hot regenerated catalytic cracking catalyst having an average particle size within the range of about 60 to 80 microns diameter withdrawn from a catalyst regenerator, and cracking said feed in said riser reactor to produce catalytically cracked products and spent catalyst which are discharged from the top of the riser into a catalyst disengaging zone wherein cracked products are separated from spent catalyst; separating cracked products from spent catalyst in said catalyst disengaging zone to produce a cracked product vapor phase which is recovered as a product and a spent catalyst phase which is discharged from said disengaging zone into a catalyst stripper contiguous with and beneath said disengaging zone; steam stripping said spent catalyst with stripping steam in said stripping zone to produce a stripper vapor comprising cracked products and stripping steam which is removed from said stripping zone as a product and a stripped catalyst phase comprising stripped catalyst having a temperature is discharged into a vertical standpipe beneath said stripping zone; discharging stripped catalyst from said standpipe into a coke combustor catalyst regeneration zone contiguous with and beneath said stripping zone operating at catalyst regeneration conditions including a temperature above 1150° F., a superficial vapor velocity above 4 feet per second and sufficient to maintain fast fluidized bed conditions to produce at least partially regenerated catalyst and flue gas containing CO and $CO_2$; afterburning within said coke combustor CO to $CO_2$ by contacting within said coke combustor said CO containing flue gas with a trapped CO combustion promoter disposed on particles having an average particle diameter of at least 500 microns and sufficiently large to have settling characteristics within said coke combustor so that the average residence time of said trapped CO combustion promoter is at least an order of magnitude larger than a residence time of said conventional FCC catalyst in said coke combustor; discharging upwardly from said coke combustor into a superimposed dilute phase transport riser mounted above said coke combustor a dilute phase mixture of flue gas and partially regenerated FCC catalyst containing at least 10% of the coke content of said stripped catalyst; discharging from said dilute phase transport riser partially regenerated FCC catalyst and flue gas containing less than 1.0 mole % CO; separating said discharged FCC catalyst from flue gas and collecting said discharged FCC catalyst in a bubbling dense phase fluidized bed encompassing at least a portion of said coke combustor; completing the regeneration of said catalyst by burning additional coke therefrom at bubbling fluidized bed catalyst regeneration conditions including a temperature of at least 1200° F., and a superficial vapor velocity below 3.0 feet per second to produce regenerated catalyst; withdrawing regenerated catalyst from said bubbling dense phase fluidized bed and charging same to said base of said riser reactor.

DESCRIPTION OF PREFERRED EMBODIMENTS

Figure 1:
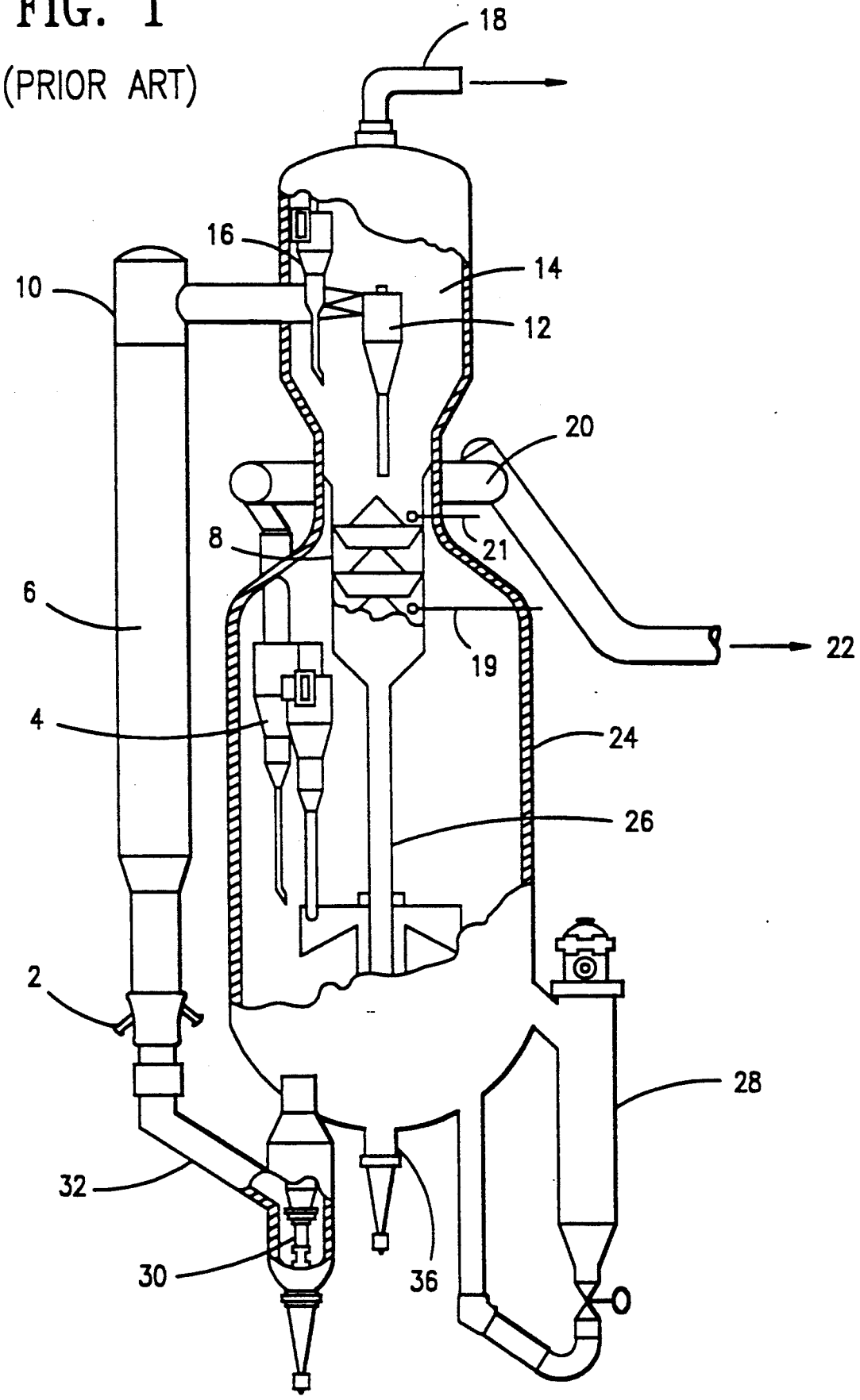
FIG. 1 (PRIOR ART)
FIG. 1 (prior art) is a schematic view of a conventional fluidized catalytic cracking unit.

FIG. 1 is a simplified schematic view of an FCC unit of the prior art, similar to the Kellogg Ultra Orthoflow converter Model F shown as FIG. 17 of Fluid Catalytic Cracking Report, in the Jan. 8, 1990 edition of Oil & Gas Journal.

A heavy feed such as a gas oil, vacuum gas oil is added to riser reactor 6 via feed injection nozzles 2. The cracking reaction is completed in the riser reactor, which takes a 90° turn at the top of the reactor at elbow 10. Spent catalyst and cracked products discharged from the riser reactor pass through riser cyclones 12 which efficiently separate most of the spent catalyst from cracked product. Cracked product is discharged into disengager 14, and eventually is removed via upper cyclones 16 and conduit 18 to the fractionator.

Spent catalyst is discharged down from a dipleg of riser cyclones 12 into catalyst stripper 8, where one, or preferably 2 or more, stages of steam stripping occur, with stripping steam admitted by means not shown in the figure. The stripped hydrocarbons, and stripping steam, pass into disengager 14 and are removed with cracked products after passage through upper cyclones 16.

Stripped catalyst is discharged down via spent catalyst standpipe 26 into catalyst regenerator 24. The flow of catalyst is controlled with spent catalyst plug valve 36.

Catalyst is regenerated in regenerator 24 by contact with air, added via air lines and an air grid distributor not shown. A catalyst cooler 28 is provided so that heat may be removed from the regenerator, if desired. Regenerated catalyst is withdrawn from the regenerator via regenerated catalyst plug valve assembly 30 and discharged via lateral 32 into the base of the riser reactor 6 to contact and crack fresh feed injected via injectors 2, as previously discussed. Flue gas, and some entrained catalyst, are discharged into a dilute phase region in the upper portion of regenerator 24. Entrained catalyst is separated from flue gas in multiple stages of cyclones 4, and discharged via outlets 8 into plenum 20 for discharge to the flare via line 22.

Figure 2:
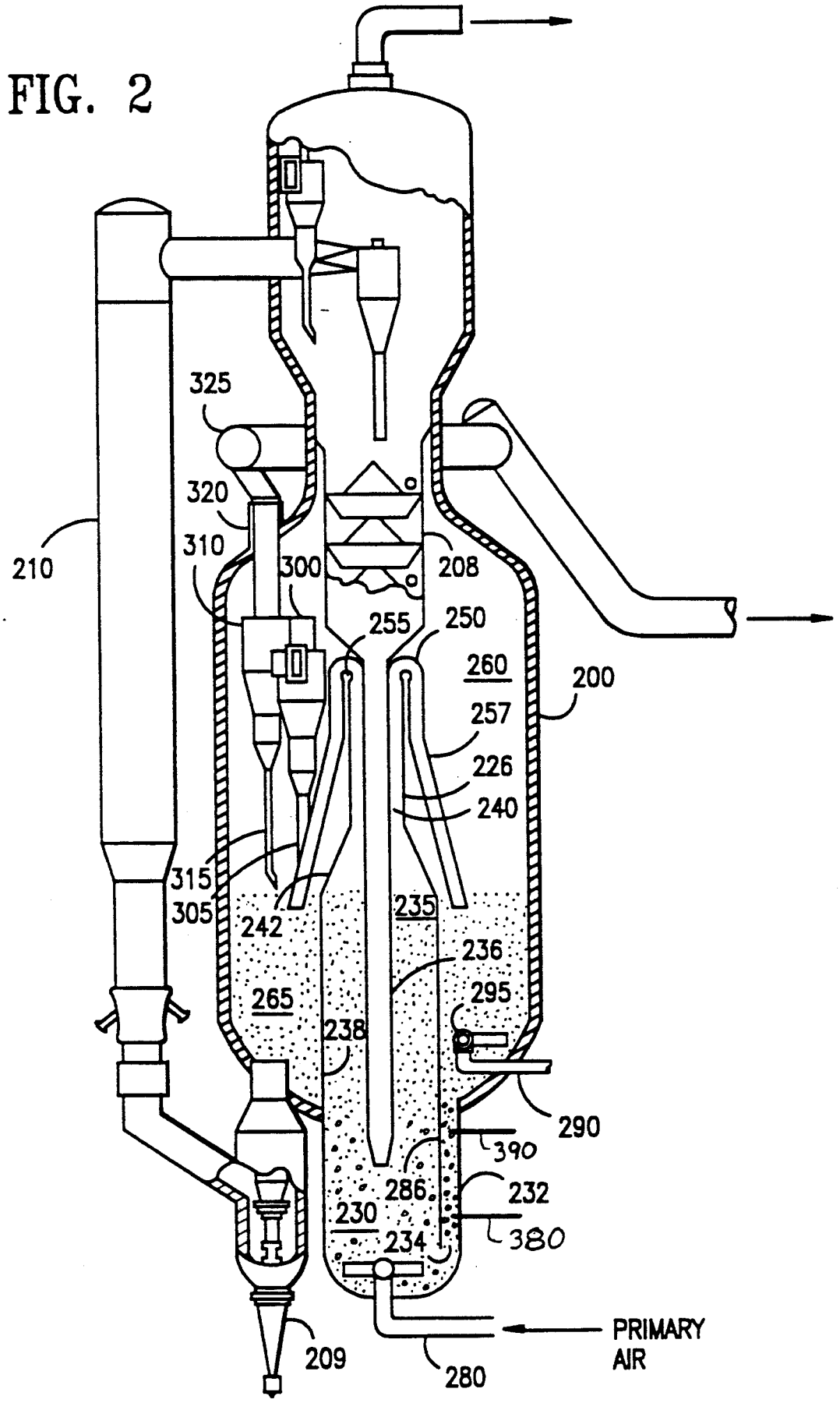
FIG. 2 (invention) is a schematic view of a preferred embodiment of the invention, showing hot catalyst recycle to an immersed coke combustor, scoop disengages on the transport riser outlet of the coke combustor, and recirculating CO combustion promoter which does not circulate with the FCC catalyst.

In FIG. 2 (invention) the changes made to the old unit are shown, and many essential and/or conventional details, such as the catalyst cooler have been omitted.

FIG. 2 shows three inventions, which work very well together to achieve true multi-stage regeneration in an Orthoflow regenerator.

A heavy feed such as a gas oil, vacuum gas oil is added to riser reactor 210 via feed injection nozzles not shown. Hot regenerated catalyst flow into the base of the riser is controlled by ceramic plug valve assembly 209. The cracking reaction is completed in the riser reactor, which discharges spent catalyst and cracked products discharged from the riser reactor pass through riser cyclones which separate most of the spent catalyst from cracked product. Cracked product is removed via upper cyclones and a conduit to the fractionator.

Spent catalyst is discharged down from a dipleg of riser cyclones 212 into catalyst stripper 208, where one, or preferably 2 or more, stages of steam stripping occur, with stripping steam admitted by means not shown in the figure. The stripped hydrocarbons, and stripping steam, pass into disengager 214 and are removed with cracked products after passage through upper cyclones 216.

Stripped catalyst is discharged down via spent catalyst standpipe 236 into a fast fluidized bed coke combustor partially within catalyst regenerator vessel 200. The flow of catalyst is controlled with a spent catalyst plug valve assembly (not shown) similar to plug valve 36 in FIG. 1.

The spent catalyst is usually at the riser top temperature, or 2 to 5 F. below this because a small amount of cooling usually occurs during stripping. This catalyst can be at 950°-1075° F., but in most units is around 975°-1025° F. Although quite hot, it is not hot enough to achieve rapid coke combustion, a temperature of at least about 1100° F., and preferably 12000° F. or higher, is needed for this. Such temperatures were easily achieved in the prior art by adding the stripped catalyst to the bubbling dense bed of catalyst at 1300° F. or so, and the large inventory of hot regenerated catalyst would heat the spent to a high enough temperature to burn coke within the residence time allowed within the regenerator.

The process of the present invention uses a coke combustor, operating at fast fluidized bed conditions, and with a short catalyst residence time in the coke combustor. It is preferred to recycle some hot regenerated catalyst into the coke combustor via trough recycle means 232. This has an inlet connective with the second fluidized bed, region 265, at the bottom thereof. Hot regenerated catalyst passes down through the passageway defined by the walls of trough recycle means 232 and a sidewall 286 of the coke combustor, with recycled catalyst passing via opening 234 into the fast fluidized bed region 230. Preferably the recycled catalyst is added near the base of the coke combustor, but this is not essential, fluidization is so vigorous in the coke combustor that it could be added to a side or even an upper portion thereof.

The flow of regenerated catalyst is controlled by varying the amount of fluidizing gas added to the trough via upper and lower gas inlets 390 and 380, respectively.

Partially, or totally, regenerated catalyst is discharged up from the coke combustor into transition region 235, where a gradual reduction in cross sectional area of the coke combustor, as shown by inverted funnel 242, forces an increase in superficial vapor velocity and dilute phase flow of catalyst and flue gas into dilute phase transport riser, region 240. Catalyst and flue gas are discharged from the transport riser via a plurality of symmetrical scoop disengagers 250. Flue gas passes via arcuate or semi-circular openings 255 into a dilute phase region 260. A majority of the spent catalyst, and usually well in excess of 90%, passes down sidearms 257 into a second fluidized bed, region 265.

Additional regeneration of catalyst preferably occurs in this second fluidized bed, which will usually be a bubbling dense bed region. Additional, or secondary air, will be added via air line 290 and distributor means 295 to this bed. Even if no additional catalyst regeneration is needed it will be necessary to add fluffing air to maintain fluidization in this region.

Flue gas, and/or fluffing air, and entrained catalyst associated therewith pass from dense bed region 265 into dilute phase region 260 above the dense bed. In this dilute phase region the two flue gas streams combine, flue gas from the coke combustor and flue gas (or fluffing air) from the second bed and enter the inlet horn of a plurality of primary cyclones 300. Recovered catalyst is discharged via diplegs 305 into the bubbling dense bed region. Vapor discharged from the primary cyclones then enters a plurality of secondary cyclones 310, which removes remaining entrained catalyst and fines and discharges a regenerator flue gas stream via vapor outlet 320 into external plenum 325.

Preferably the regenerator operates with a CO combustion additive on relatively large size particles, such as TCC beads. Such fast settling CO combustion promoter will remain a long time in the fast fluid bed region 230, because its slip rate is similar to that of the superficial vapor velocity in the FFB region. Even when the bead slip rate substantially exceeds the superficial vapor velocity in the FFB region there will be considerable traffic of beads into the transition region 235 because of the way fluidized beds operate, and once in the transition region, and certainly in the dilute phase region 240 the vapor velocity will be sufficient to sweep the beads along with the flow of gas in the dilute phase region. Beads will be almost completely recovered by the scoop disengagers, and will rapidly settle or pass through the dense bed region 265 and flow around to catalyst recycle means 232.

Regenerated catalyst is withdrawn from the regenerator dense bed region 265 by plug valve assembly 209 and discharged into the base of the riser reactor 210 to contact and crack fresh feed.

DESCRIPTION OF PREFERRED EMBODIMENTS

FCC Feed

Any conventional FCC feed can be used. The process of the present invention is especially useful for processing difficult charge stocks, those with high levels of CCR material, exceeding 2, 3, 5 and even 10 wt % CCR.

The feeds may range from the typical, such as petroleum distillates or residual stocks, either virgin or partially refined, to the atypical, such as coal oils and shale oils. The feed frequently will contain recycled hydrocarbons, such as light and heavy cycle oils which have already been subjected to cracking.

Preferred feeds are gas oils, vacuum gas oils, atmospheric resids, and vacuum resids, and mixtures thereof. The present invention is very useful with heavy feeds having, and with those having a metals contamination problem. With these feeds, the possibility of reduced burning load in the regenerator, and even more importantly, the possibility of a dryer regenerator, because of reduced hydrogen content of coke, will be a significant benefit.

FCC Catalyst

Any commercially available FCC catalyst may be used. The catalyst can be 100% amorphous, but preferably includes some zeolite in a porous refractory matrix such as silica-alumina, clay, or the like. The zeolite is usually 5–40 wt. % of the catalyst, with the rest being matrix. Conventional zeolites include X and Y zeolites, with ultra stable, or relatively high silica Y zeolites being preferred. Dealuminized Y (DEAL Y) and ultrahydrophobic Y (UHP Y) zeolites may be used. The zeolites may be stabilized with Rare Earths, e.g., 0.1 to 10 Wt % RE.

Relatively high silica zeolite containing catalysts are preferred for use in the present invention. They withstand the high temperatures usually associated with complete combustion of CO to $CO_2$ within the FCC regenerator.

The catalyst inventory may also contain one or more additives, either present as separate additive particles, or mixed in with each particle of the cracking catalyst. Additives can be added to enhance octane (shape selective zeolites, i.e., those having a Constraint Index of 1–12, and typified by ZSM-5, and other materials having a similar crystal structure), adsorb SOX (alumina), remove Ni and V (Mg and Ca oxides).

Additives for removal of SOx are available from several catalyst suppliers.

CO combustion additives, or FCC catalyst with CO combustion promoter built into the catalyst, are available from most FCC catalyst vendors. Such additives have fluidization properties similar to conventional FCC catalyst, and circulate with the catalyst.

The preferred non-circulating, large particle additives may be purchased from vendors such as Intercat. The large balls of CO combustion promoter taught by Wilson Jr. et al in U.S. Pat. No. 3,808,121 may be used, or even fresh or spent reforming catalyst. These noncirculating promoters may be used as a supplement for, or preferably a complete or partial replacement of conventional circulating CO combustion promoters.

The FCC catalyst composition, per se, forms no part of the present invention.

Cracking Reactor/Regenerator

The FCC reactor and regenerator shell 24, per se, are conventional, and are available from the M. W. Kellogg Company.

The modifications needed to implement the claimed invention are well within the skill of the art, when supplemented with the teachings herein. Some general and specific guidelines follow, directed both to the FCC process in general, and the claimed invention.

FCC Reactor Conditions

Conventional riser cracking conditions may be used. Typical riser cracking reaction conditions include catalyst/oil ratios of 0.5:1 to 15:1 and preferably 3:1 to 8:1, and a catalyst contact time of 0.1 to 50 seconds, and preferably 0.5 to 5 seconds, and most preferably about 0.75 to 2 seconds, and riser top temperatures of 900° to about 105° F.

Stripping Conditions

Conventional stripping operating conditions may be used. Preferably hot stripping, as taught in our earlier patents, is practiced. Typical hot stripper operating conditions include temperatures which are at least 20° F. above the temperature in the conventional stripping zone, preferably at least 50° F. above the temperature in the conventional stripper, and most preferably temperatures in the hot stripper are at least 100° F. or more hotter.

A stripping gas or medium, preferably steam, is used in all strippers. Preferably from 0.5 to 5.0 wt % steam, based on the weight of spent catalyst, is added to the stripping zone, in addition to the amount of stripping steam used in the conventional stripper.

Coke Combustor/Catalyst Recirculation

The process of the present invention calls for a coke combustor immersed within the fluidized bed of regenerated catalyst maintained in an Orthoflow type regenerator, such as that shown in the figures.

The coke combustor is not, per se, the present invention, such devices are used in refineries throughout the world as part of a high efficiency FCC regenerator design. All commercial high efficiency regenerators are believed to operate with an external catalyst recycle line, with catalyst flow controlled by one or more hydraulic slide valves. These valves, usually costing over $1,000,000, and usually used in pairs to permit maintenance work during operation, are believed essential by most refiners for positive control over catalyst recirculation to the coke combustor. Such valves can not be used in an Orthoflow regenerator.

The design shown in FIG. 2 is preferred, but other designs are possible for the fast fluid bed region. An Orthoflow type regenerator design is known involving use of a suspended bell coke combustor, as shown in U.S. Pat. No. 5,032,251.

The preferred, FIG. 2 design, has a sealed coke combustor. A U trap or preferably a trough conduit as shown in FIG. 2 transfers hot regenerated catalyst from the second fluidized bed to the coke combustor provided. This design also provides an ideal way to reliably move both the conventional FCC catalyst and bead type CO combustion promoter from the dense bed region to the coke combustor.

By control of the amount of fluidizing gas used at one or more places within the device, flow can be essentially turned off or flow unimpeded. Unlike most valveless catalyst flow control means, this trough flow controller reduces catalyst circulation as air flow is increased. This effect will be discussed at greater length in the discussion of trough design.

While use of, e.g. a fluidized U trap to move fluidized catalyst from one fluidized bed to another is not new, it has never been done in a coke combustor immersed in an Orthoflow regenerator, and never been done in such a way that increasing air flow decreased catalyst flow. The trap concept of FIG. 2, which is only ½ of a classical U trap, and with fluidization gas on the wrong side of the U, works especially well when transporting a mix of bead CO combustion promoter and FCC catalyst, in that the beads can help seal the base of the trap or trough, or limit catalyst flow therethrough, if desired.

Most of the implementation of the design of the trough is conventional and routine. Those skilled in the design of cracking units can calculate the relative sizes of the bubbling dense bed, the fast fluid bed region, the relative head available to drive fluid flow from the dense bed region to the FFB region, and size the unit from there in accordance with the following guidelines.

We prefer to operate with a bubbling dense bed having a depth of at least 2 and less than 20 feet, preferably with 4 to 15' and most preferably with 5 to 10' of depth. We prefer to minimize the size of the bubbling bed. There should be enough bed depth to seal the return line to the reactor and to seal trough recycle line and to provide the residence time desired for additional catalyst regeneration, if any, in the bubbling bed. We refer to a bubbling dense bed, because in practice most of these units will continue to operate this portion of the units as a bubbling dense bed (to meet other unit constraints such as catalyst entrainment in the dilute phase region), but more vigorously fluidized regimes may be used, such as turbulent fluidized beds.

When operated as a conventional bubbling dense bed, with a superficial vapor velocity of around 2 to 2½ fps the bubbling dense bed density will typically range from 29 to 30 #/cubic foot to 30 to 35 #/cubic foot. There are different places to measure such densities, and different ways of interpreting results, but these numbers are typical.

The coke combustor, or fast fluid bed region should have a depth at least equal to that of the bubbling bed, and may be much deeper, or taller, than the bubbling bed. FFB regions having a depth 20% or 50% or even 100% greater than the bubbling bed are contemplated. In many installations the FFB region will share a common floor with the bubbling bed (the floor being the shell of the previous regenerator vessel), and the FFB height will be from 10 to 20–25'. Superficial vapor velocity in the FFB region is the primary factor in creating a fast fluidized bed region. The superficial vapor velocity may range from a low of around 3 up to about 10 fps. For most FCC units, these are the upper and lower limits on fast fluidization, with velocities lower than this giving bubbling fluidized bed conditions, and velocities higher than this leading to dilute phase flow. Preferably the FFB region operates at about 4 to 8 feet per second, and most preferably at about 4.5 to 6 fps of superficial vapor velocity.

When operating as a conventional FFB, the superficial vapor velocity will be around 5 fps, and the dense phase density may range from perhaps as low as around 5 #/ft$^3$, up to 10 to 15 #/ft$^3$, while the upper regions of the FFB region will be in dilute phase, with a much lower density, ranging from perhaps as low as around 1–1½#/ft$^3$ up to 2–5#/ft$^3$. There are different ways and different places to measure these densities, but those skilled in the cracking arts would recognize these vapor velocities and catalyst densities as typical of fast fluid bed conditions.

The trough or valveless catalyst transfer means permitting catalyst to flow from the bubbling dense bed region to the coke combustor preferably has a cross sectional sufficient to permit the desired amount of catalyst to flow from one region to the other. In many units, from 0.3 to 3, and preferably from 1 to 2, weights of hot regenerated catalyst will flow into the coke combustor per weight of stripped catalyst entering the coke combustor. It is important to have at least about 1100° F. in the coke combustor to "light" the coke combustor, and most refiners recycle much more than this minimum amount.

Because the material in the trough will usually be in the dense phase, a small trough, with only 3 to 25% of the surface area of the FFB region will usually suffice.

The trough or transfer means should have a height equal to at least 50% of the dense bed depth, and preferably has a height equal to the dense bed depth, or more. If the dense bed is 6' deep, a trough should be at least 3' deep.

The trough should include one or more air or other fluidizing gas inlet means, preferably at a plurality of elevations in the trough. If both FFB and bubbling bed region share a common floor, and the bubbling bed region is 6' deep, and the trough comprises a scallop or cut length of pipe 4' long, fluidization air inlets may be provided at 1' and 3' above grade. The fluidization air should not be added at the base of the trough, or at a 0' elevation as that would cause most of the air to short circuit directly into the FFB region.

Addition of fluidizing air at such intermediate trough elevations, 1' and 3' will reduce the density of material in the trough, and reduce the head or driving force used to move catalyst from the bubbling bed to the FFB region. If large amounts of fluidizing air or other gas are added, this trough region can be forced into the fast fluidized bed flow regime so that there will be very little driving force (only 2' in this scenario) and the material flowing will have a low density, so that not much catalyst will be transferred from the bubbling bed region to the FFB.

Reducing the amount of fluidizing air added to the trough will increase the density of material in the trough, and increase catalyst flow from the second bed to the FFB region. The density in the trough can be increased to 15–40 #/ft$^3$ depending of superficial vapor velocity in the fluidized bed in the trough.

This sort of arrangement, a common floor for FFB, trough base, and bubbling bed, will complicate circulation of bead or other large particulate catalyst, and is included to show the relative elevations of dense bed, trough depth, and trough air inlets. It would be necessary to provide some means for transferring bead CO combustion promoter from the dense bed region to the FFB region independent of the trough, if the trough inlet were 4' up in the dense bed. Thus a small notch could be cut in the base of the FFB region to allow a limited amount of catalyst traffic, and for return of entrained large particles or bead CO combustion promoter to the FFB region.

Preferably the trough inlet is near the base or floor of the bubbling bed region, as shown in FIG. 2. This makes the trough an almost automatic method of recycling entrained large bead CO combustion promoter to the FFB region.

Circulating CO Combustion Promoter

Use of a circulating co combustion promoter in the regenerator or combustion zone is not essential for the practice of the present invention, however, it is preferred. These materials are well-known.

U.S. Pat. No. 4,072,600 and U.S. Pat. No. 4,235,754, which are incorporated by reference, disclose operation of an FCC regenerator with from 0.01 to 100 ppm Pt metal or enough other metal to give the same CO oxidation, may be used with good results. Very good results are obtained with as little as 0.1 to 10 wt. ppm platinum present on the catalyst in the unit.

Non-Circulating CO Combustion Promoter

The trapped, or non-circulating CO combustion promoters, are an essential part of the present invention. They provide a way to achieve complete CO combustion in the coke combustor, but only partial coke combustion.

By the term non-circulating, we mean that the CO combustion promoter does not have fluidization characteristics like the conventional FCC catalyst. Preferably the FCC regenerator is designed so that the large particle CO combustion promoter will have at least an order of magnitude longer residence time in the FFB region of the regenerator than the conventional FCC catalyst, and preferably 2 or 3 orders of magnitude more residence time in the regenerator considered as a whole than the FCC catalyst.

The "non-circulating" promoters preferably circulate a lot within the regenerator, i.e., they preferably will have considerably up and down mobility within the coke combustor, and also may circulate freely from the second dense bed back to the coke combustor.

We believe this free circulation of catalyst, and of a fast settling larger particle coke combustor which does not circulate, is the key to a robust design. Our approach, when coupled with appropriate regenerator design, lends itself to operating with unusual amounts of Pt combustion promoter in the catalyst, but without sending this Pt to the cracking reactor.

The non-circulating promoter is preferably a relatively high surface area, alumina-rich material, which is highly attrition resistant. Moving bed cracking catalyst support, with or without any zeolite present, provides an excellent support for our preferred CO combustion promoter. Such supports are about ⅛" in diameter and are readily fluidized. Moving bed cracking units used an "air lift" to move such particles around moving bed cracking units, provided sufficiently high vapor velocities are present. Such materials are also amazingly strong, even though they have an apparent bulk density similar to that of conventional FCC catalyst.

These support materials, which may be termed for purposes of convenience, "bead CO combustion promoter" will have usually have particle sizes above 200 microns, and preferably of 250 to 25,000 microns, more preferably 500 to 12,500 microns. The TCC bead catalyst discussed above, having a roughly ⅛" diameter (roughly 3000 microns) has almost ideal fluidization properties, as it has a settling velocity at FCC conditions of around 6–8 fps, and will stay a long time within the FFB region, and yet be able to move freely within the region. This permits the benefits of high Pt loading to be seen or felt throughout the FFB region, rather than in just a thin layer where larger particles would accumulate.

Less preferred are conventional moving bed reforming catalysts, or even conventional sized particles of fixed bed reforming catalyst, typically spheres or extrudates having an average particle size of about 1/16th inch. The extrudates do not have the favorable flow characteristics of spheres, and are not preferred, but they should work. Spent reforming catalyst may be better used in many refineries as a non-circulating CO combustion promoter than as Pt source.

The optimum size and physical properties of the non-circulating support correlates to a great extent with the unit design. If a refiner wishes to operate with a CO combustion promoter, and coke combustor design, so that the promoter is essentially trapped within the CO combustion promoter, then a relatively dense, fast settling promoter, with relatively large amounts of Pt present is preferred. Large, dense extrudates will work well in such service, but much of the coke combustor will operate without the apparent presence of Pt because of the rapid settling characteristics of such materials.

When a refiner wishes to promote extensive circulation of non-circulating promoter from the coke combustor through the dilute phase transport riser to the second dense bed, a bead type promoter is preferred along with superficial vapor velocities sufficiently high to ensure transport of beads throughout, and out of, the FFB region. To maximize use of promoter to transfer heat, and to also promote CO combustion, it will be best to adjust the settling characteristics in the coke combustor and transport riser to that of the bead, so that circulation rates of beads approach, or even exceed, the circulation, by weight, of conventional cracking catalyst, and also to operate so that 30 wt % to 50 wt % or even more of the particulate matter in the coke combustor is recycled beads rather than FCC catalyst.

This approach has many advantages. The residence time of the FCC catalyst in the high steam environment of the coke combustor is reduced. Heat transfer from the second bed (of hot regenerated catalyst) is accomplished to a great extent by transferring heat from catalyst in the second dense bed to the beads sinking through the second bed and returning to the coke combustor. Reducing the residence time of spent catalyst in the coke combustor, and presence of large amounts of Pt in the coke combustor, provide a broad operating window in which partial coke combustion, but complete CO combustion, may be achieved. Conditions can be set so that the coke combustor can reliably burn from, e.g., 10 to 90% of the total coke on catalyst while achieving complete CO combustion at all times.

By complete CO combustion we do not necessarily mean that the flue gas discharged from the dilute phase transport riser will contain 100 ppm or less CO, but we do mean that the flue gas will contain so little CO that the amount of afterburning can be readily tolerated when this stream combines with an oxygen rich flue gas from the second fluidized bed.

Scoop Disengager

The coke combustor and dilute phase transport riser discharge a mixture of at least partially regenerated catalyst and flue gas into the dilute phase region above the second fluidized bed, or second dense bed, in the Orthoflow regenerator.

In conventional high efficiency regenerators the mixture is simply discharged, usually sideways or down, into a large diameter region above a bubbling dense bed. This would cause disastrous particulate loading in a conventional regenerator, but can be tolerated in single stage high efficiency regenerators because of the low superficial vapor velocities in the second dense bed and dilute phase region above it.

This unrestrained discharge of catalyst into a dilute phase region above an active regenerator would cause excessive catalyst traffic in the dilute phase. While a cyclone separator could be added to the dilute phase riser discharge, this also adds a lot of weight, cost, and pressure drop to the unit.

The design of the present invention preferably includes a scoop disengager to effect a 90+% separation of FCC catalyst from flue gas exiting the transport riser. Of course such a design will recover well over 99% of bead type promoter, if bead type CO combustion promoter is used. It achieves enough separation of FCC catalyst to permit much higher superficial vapor velocities to be used in the second fluidized bed.

Alternative designs may also be used, such as a cyclone separator on the transport riser outlet, or redesign of the regenerator cyclones. The scoop disengager shown is preferred.

We claim:

1. A fluidized catalytic cracking process wherein a heavy hydrocarbon feed comprising hydrocarbons having a boiling point above about 650° F. is catalytically cracked to lighter products comprising the steps of:

catalytically cracking said feed in a catalytic cracking zone operating at catalytic cracking conditions by mixing, in the base of a riser reactor, a heavy crackable feed with a source of hot regenerated catalytic cracking catalyst having an average particle size within the range of about 40 to 100 microns diameter withdrawn from a catalyst regenerator, and cracking said feed in said riser reactor to produce catalytically cracked products and spent catalyst which are discharged from the top of the riser into a catalyst disengaging zone wherein cracked products are separated from spent catalyst separating cracked products from spent catalyst in said catalyst disengaging zone to produce a cracked product vapor phase which is recovered as a product and a spent catalyst phase which is discharged from said disengaging zone into a catalyst stripper contiguous with and beneath said disengaging zone;

steam stripping said spent catalyst with stripping steam in said stripping zone to produce a stripper vapor comprising cracked products and stripping steam which is removed from said stripping zone as a product and a stripped catalyst phase comprising stripped catalyst having a temperature is discharged into a vertical standpipe beneath said stripping zone;

discharging stripped catalyst from said standpipe into a coke combustor catalyst regeneration zone contiguous with and beneath said stripping zone operating at catalyst regeneration conditions including a temperature above 1100° F., a superficial vapor velocity above 3 feet per second and sufficient to maintain at least turbulent or fast fluidized bed conditions to produce at least partially regenerated catalyst and flue gas containing CO and $CO_2$;

afterburning within said coke combustor CO to $CO_2$ by contacting within said coke combustor said CO containing flue gas with a trapped CO combustion promoter disposed on particles having an average particle diameter of at least 250 microns and sufficiently large to have settling characteristics within said coke combustor so that the average residence time of said trapped CO combustion promoter is at least an order of magnitude larger than a residence time of said conventional FCC catalyst;

discharging upwardly from said coke combustor a dilute phase mixture of flue gas and at least partially regenerated FCC catalyst into a superimposed dilute phase transport riser mounted above said coke combustor;

discharging from said dilute phase transport riser at least partially regenerated FCC catalyst and flue gas containing less than 2.0 mole % CO;

separating said discharged FCC catalyst from flue gas and collecting said discharged FCC catalyst in a dense phase fluidized bed encompassing at least a portion of said coke combustor;

withdrawing regenerated catalyst from said dense phase fluidized bed and charging same to said base of said riser reactor.

2. The process of claim 1 wherein flue gas discharged from said dilute phase transport riser contains less than 1.0 mole % CO.

3. The process of claim 1 wherein flue gas discharged from said dilute phase transport riser contains less than 0.5 mole % CO.

4. The process of claim 1 wherein said trapped CO combustion promoter has a diameter of 500 to 12,500 microns.

5. The process of claim 1 wherein said trapped CO combustion promoter has a diameter of 1000 to 5000 microns.

6. The process of claim 1 wherein said trapped CO combustion promoter is Pt impregnated bead cracking catalyst having a diameter of about ⅛".

7. The process of claim 1 wherein the superficial vapor velocity in said coke combustor is 4 to 8 feet per second.

8. The process of claim 1 wherein the superficial vapor velocity in said coke combustor is 4.5 to 6 feet per second.

9. The process of claim 1 wherein additional regeneration gas is added to said dense phase fluidized bed and additional catalyst regeneration, equal to removal of 5 to 75% of the coke on spent catalyst, occurs in said dense bed.

10. The process of claim 10 wherein 10 to 50% of the coke on spent catalyst is removed in said dense bed.

11. A fluidized catalytic cracking process wherein a heavy hydrocarbon feed comprising hydrocarbons having a boiling point above about 650° F. is catalytically cracked to lighter products comprising the steps of:

catalytically cracking said feed in a catalytic cracking zone operating at catalytic cracking conditions by mixing, in the base of a riser reactor, a heavy crackable feed with a source of hot regenerated catalytic cracking catalyst having an average particle size within the range of about 60 to 80 microns diameter withdrawn from a catalyst regenerator, and cracking said feed in said riser reactor to produce catalytically cracked products and spent catalyst which are discharged from the top of the riser into a catalyst disengaging zone wherein cracked products are separated from spent catalyst separating cracked products from spent catalyst in said catalyst disengaging zone to produce a cracked product vapor phase which is recovered as a product and a spent catalyst phase which is discharged from said disengaging zone into a catalyst stripper contiguous with and beneath said disengaging zone;

steam stripping said spent catalyst with stripping steam in said stripping zone to produce a stripper vapor comprising cracked products and stripping steam which is removed from said stripping zone as a product and a stripped catalyst phase comprising stripped catalyst having a temperature is discharged into a vertical standpipe beneath said stripping zone;

discharging stripped catalyst from said standpipe into a coke combustor catalyst regeneration zone contiguous with and beneath said stripping zone operating at catalyst regeneration conditions including a temperature above 1150° F., a superficial vapor velocity above 4 feet per second and sufficient to maintain fast fluidized bed conditions to produce at least partially regenerated catalyst and flue gas containing CO and $CO_2$;

afterburning within said coke combustor CO to $CO_2$ by contacting within said coke combustor said CO containing flue gas with a trapped CO combustion promoter disposed on particles having an average particle diameter of at least 500 microns and sufficiently large to have settling characteristics within said coke combustor so that the average residence time of said trapped CO combustion promoter is at least an order of magnitude larger than a residence time of said conventional FCC catalyst in said coke combustor;

discharging upwardly from said coke combustor into a superimposed dilute phase transport riser mounted above said coke combustor a dilute phase mixture of flue gas and partially regenerated FCC catalyst containing at least 10 % of the coke content of said stripped catalyst;

discharging from said dilute phase transport riser partially regenerated FCC catalyst and flue gas containing less than 1.0 mole % CO;

separating said discharged FCC catalyst from flue gas and collecting said discharged FCC catalyst in a bubbling dense phase fluidized bed encompassing at least a portion of said coke combustor;

completing the regeneration of said catalyst by burning additional coke therefrom at bubbling fluidized bed catalyst regeneration conditions including a temperature of at least 1200° F., and a superficial vapor velocity below 3.0 feet per second to produce regenerated catalyst;

withdrawing regenerated catalyst from said bubbling dense phase fluidized bed and charging same to said base of said riser reactor.

* * * * *